United States Patent [19]

Jobling et al.

[11] 4,339,919

[45] Jul. 20, 1982

[54] FLEXIBLE MUFFLER MOUNTING

[75] Inventors: Lancelot A. Jobling, Mentor; Charles J. Sabec, Pepper Pike; Ronald C. Stump, Mentor, all of Ohio

[73] Assignee: Towmotor Corporation, Mentor, Ohio

[21] Appl. No.: 135,961

[22] Filed: Mar. 24, 1980

[51] Int. Cl.[3] ..... F01N 7/08

[52] U.S. Cl. ..... 60/322; 180/296; 180/309; 248/610; 248/630

[58] Field of Search ..... 60/272, 322; 180/309, 180/296, 89.2; 248/630, 610

[56] References Cited

U.S. PATENT DOCUMENTS

| | | | |
|---|---|---|---|
| 2,925,874 | 2/1960 | Norrie | 180/296 |
| 3,270,992 | 9/1966 | Cassel | 248/610 |
| 3,942,599 | 3/1976 | Shimada | 180/296 |
| 3,960,232 | 6/1976 | Hubbell | 180/309 |
| 4,031,700 | 6/1977 | Yamazaki | 60/322 |
| 4,074,525 | 2/1978 | Salver | 180/296 |
| 4,081,959 | 4/1978 | Yokota | 60/322 |

FOREIGN PATENT DOCUMENTS

| | | | |
|---|---|---|---|
| 841649 | 6/1952 | Fed. Rep. of Germany | 248/610 |
| 2017999 | 10/1971 | Fed. Rep. of Germany | 248/630 |
| 2913733 | 10/1979 | Fed. Rep. of Germany | 60/302 |

*Primary Examiner*—Douglas Hart

*Attorney, Agent, or Firm*—Phillips, Moore, Weissenberger, Lempio & Majestic

[57] ABSTRACT

A muffler mounting (26) for a muffler (21) which is connected to an internal combustion engine (11) by a rigid exhaust pipe (16). Previous mountings for such mufflers have either been of the rigid type, which subjects the muffler to undesired stresses resulting from shock, vibration or thermal expansion, or have utilized flexible rubber belting hangers which deteriorate rapidly when subjected to high temperatures. The present invention provides a relatively thin, flexible, generally-vertical metal hanger (52) comprised of a plurality of thin, stainless steel, strips (53) overlaid on one another, to flexibly connect and support the muffler (21) to the engine (11) or frame (12). The present invention is particularly useful in vehicles wherein the engine (11) is resiliently mounted on the frame (12) and wherein the muffler mounting (26) is subject to high temperatures, corrosion, and oxidation.

9 Claims, 4 Drawing Figures

FIG.2.
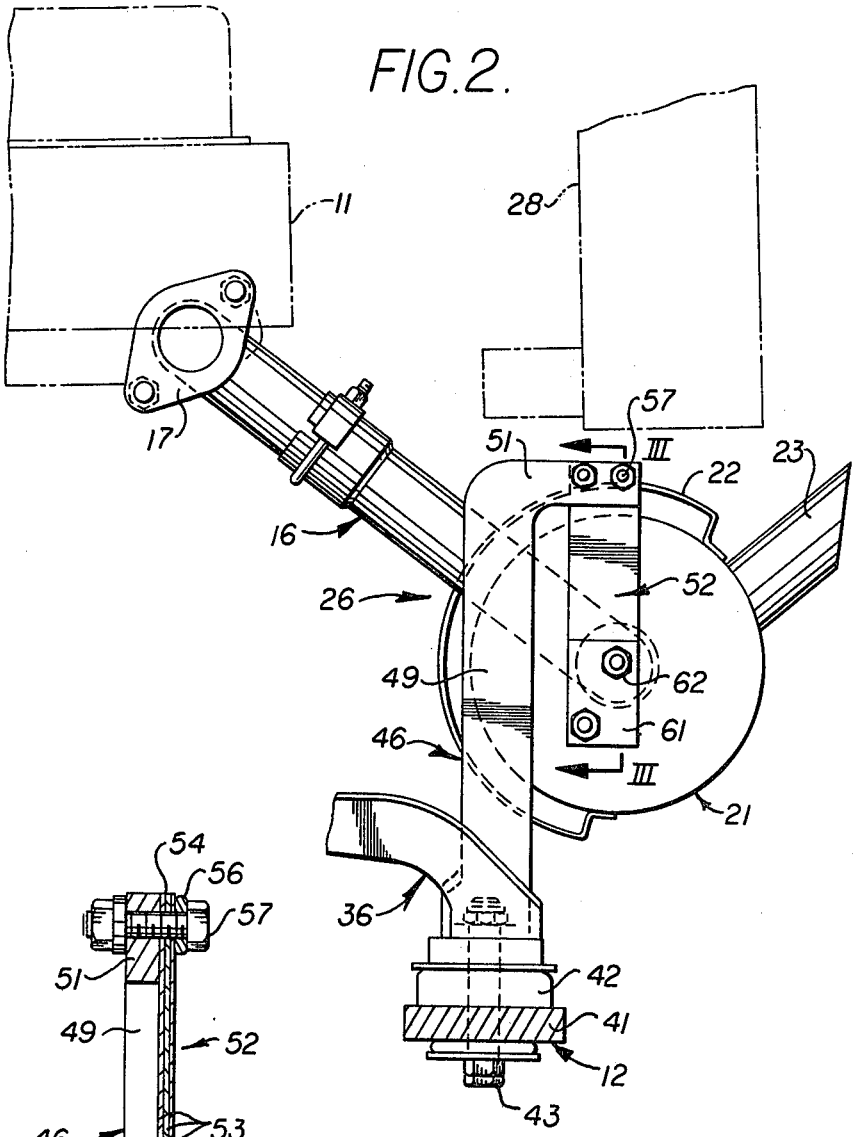
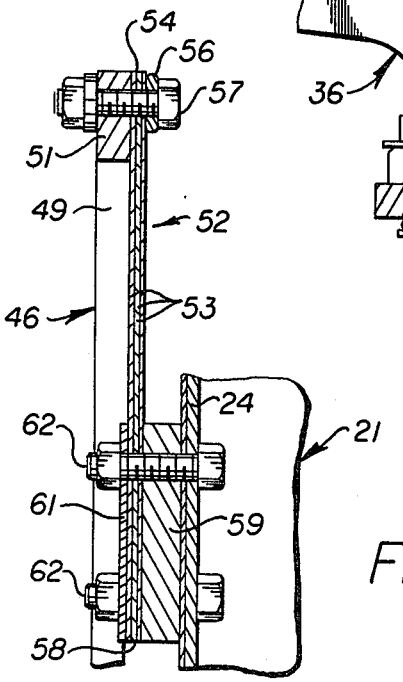
FIG.3.

FLEXIBLE MUFFLER MOUNTING

TECHNICAL FIELD

This invention relates generally to internal combustion engines and exhaust systems and more particularly to a mounting for the muffler in such system.

BACKGROUND ART

In a typical vehicular environment, an internal combustion engine will be resiliently mounted on the frame of the vehicle and the exhaust system for the engine will include a rigid exhaust pipe extending from the exhaust manifold of the engine to a muffler with the hot exhaust gases then being discharged from the muffler through a tail pipe.

Such a system poses significant problems in the provision of a reliable, simple and inexpensive support for the muffler.

Because of the resilient engine mount, the engine will vibrate in many planes during operation, even when the vehicle is not moving. Such vibrations will be imparted to the muffler through the rigid exhaust pipe causing the muffler to similarly vibrate. Movement of the vehicle, particularly over rough terrain, will cause further shock and vibration of the muffler. The muffler support must, of course, have sufficient strength to support the weight of the muffler and prevent vibration and shock from causing failure of the exhaust pipe or muffler.

The heat of the hot exhaust gases also presents a problem in that such heat will cause the exhaust pipe and muffler to expand and shift relative to the engine. The muffler support must also allow for relief of these stresses.

The hot exhaust gases further present a problem in that the muffler becomes quite hot during operation and such heat will be transmitted by conduction to the muffler support. As a consequence, the muffler support must be able to withstand high temperatures without failure. This problem is increased in instances wherein the design of the vehicle makes it necessary to locate the muffler in a crowded space with a minimal amount of cooling air flow past the muffler.

Corrosion from road contaminates and oxidation are further problems to be considered in providing a suitable muffler support which will not fail prematurely.

Attempts have been made to mount the muffler rigidly to the engine so that there is no relative movement of the engine and muffler due to shock and vibration. In general, such attempts have not been satisfactory as the rigid mounts are subject to breaking and they restrain the muffler in such manner that substantial stresses are imposed on the muffler because of thermal expansion thereof.

Flexible rubber belting straps members have also been used to suspend the mufflers. Such rubber belting straps do aid in protecting the muffler against shock, vibration and thermal expansion, but they are adversely affected by high temperatures and have a relatively short life before failure.

In summary, there is a need for a simple, inexpensive and reliable muffler mount which will bear the weight of the muffler, which will withstand shock, vibration and thermal expansion forces, which is heat resistant, and which is resistant to corrosion and oxidation.

DISCLOSURE OF INVENTION

The present invention is directed to overcoming one or more of the problems as set forth above.

In one aspect of the invention, this is accomplished in an engine and exhaust system wherein a muffler is connected at one location thereon to an engine by a rigid exhaust pipe extending therebetween by providing a rigid support bracket and a generally-vertical, flexible metal hanger fixed at the upper end thereof to the support bracket and fixed at the lower end thereof to another location on the muffler.

In another aspect of the invention, the flexible hanger comprises a plurality of individual strip elements overlaid on one another.

The foregoing and other aspects will become apparent from the following detailed description of the invention when considered in conjunction with the accompanying drawings.

BRIEF DESCRIPTION OF DRAWINGS

FIG. 2 is an enlarged view of a portion of FIG. 1.

FIG. 3 is an elevational sectional view of the muffler support embodiment, taken on line III—III of FIG. 2.

BEST MODE FOR CARRYING OUT THE INVENTION

Figure 1:
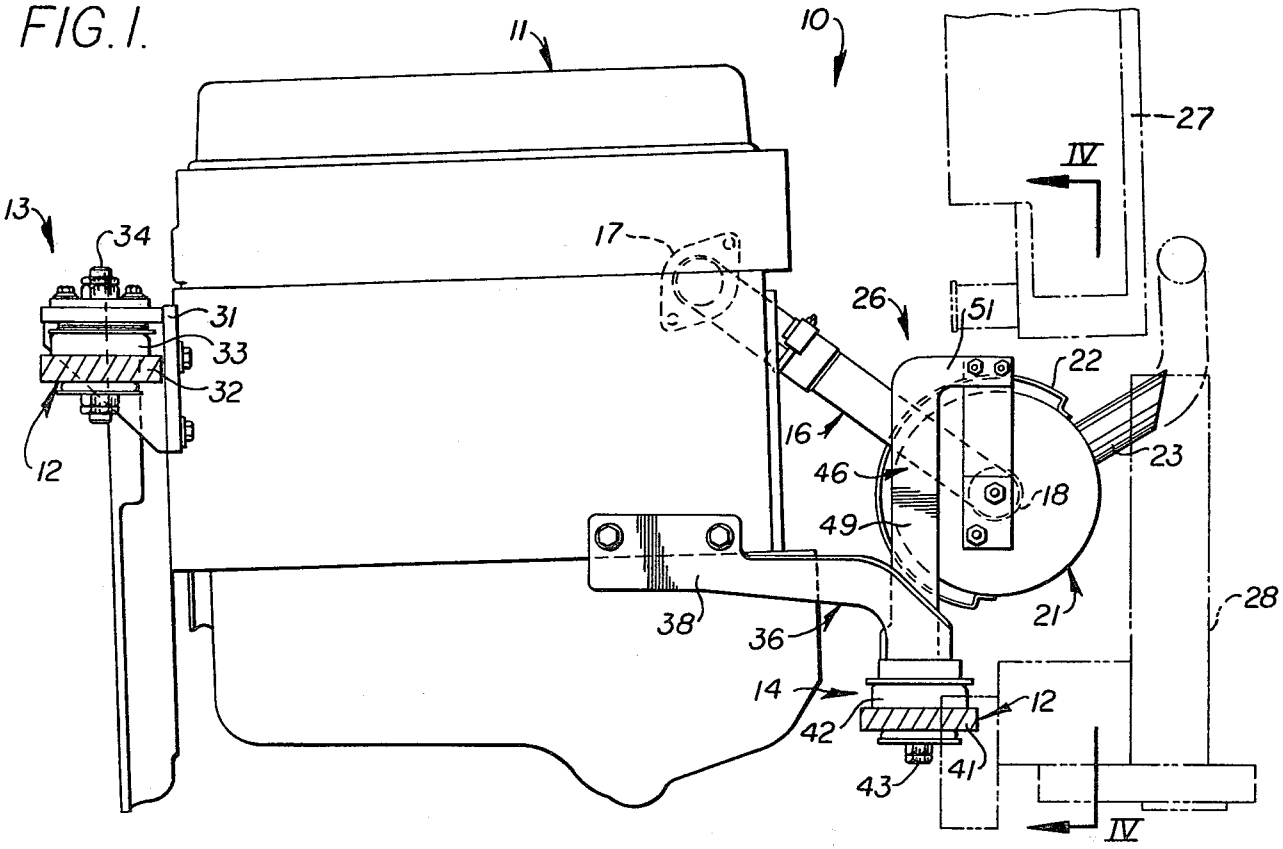
FIG. 1 is a side elevational view, with portions shown in phantom and portions shown in section, of an engine and exhaust system and a muffler support embodiment of the present invention.
Figure 4:
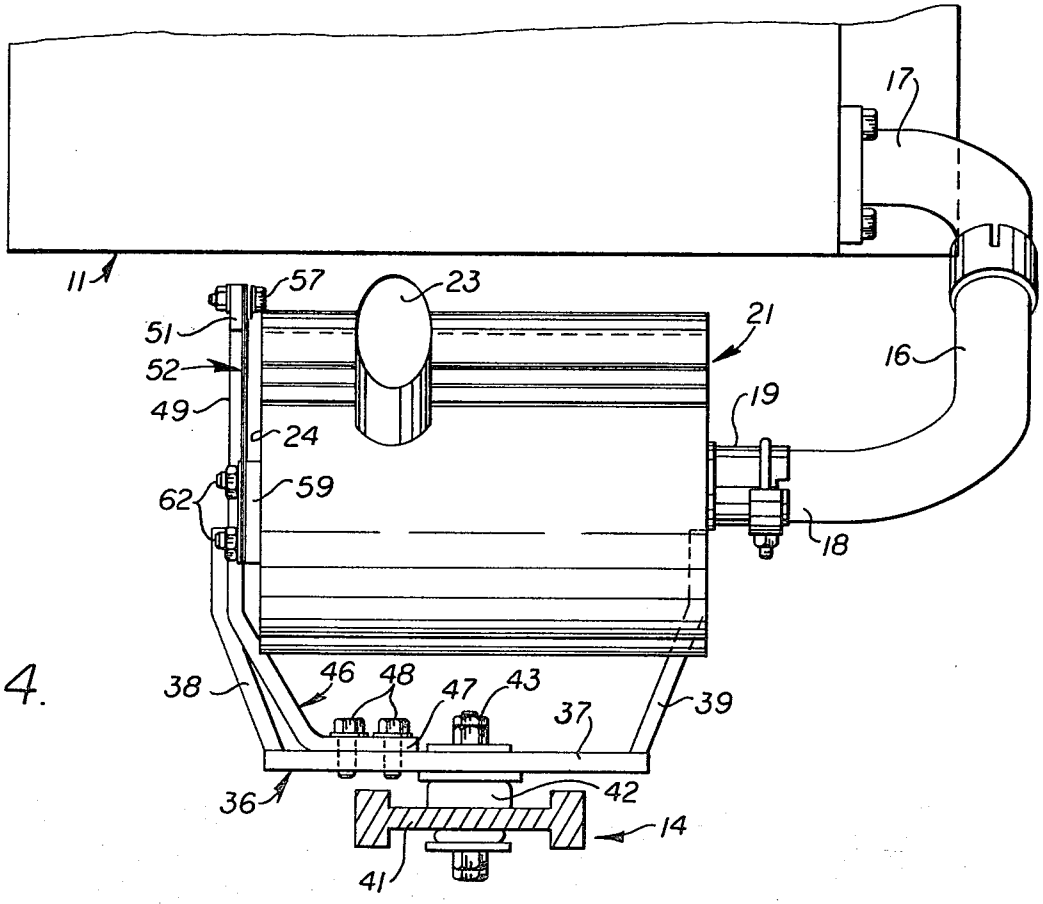
FIG. 4 is an end elevational view, as seen generally from line IV—IV of FIG. 1.

Referring now to the drawings, FIG. 1 illustrates an engine and exhaust system 10 including an internal combustion engine 11 resiliently mounted on, or connected to, a vehicle frame 12 by a pair of laterally-spaced, front engine mounts 13 (only one of which mounts is shown) at the front of the engine and by a rear engine mount 14 at the rear of the engine. A rigid exhaust pipe 16 is rigidly connected at a first end 17 thereof to engine 11 and at the second end 18 thereof to a first end 19 of muffler 21 (FIG. 4). Muffler 21 is typically of elongated, substantially cylindrical shape and is generally horizontally disposed and spaced away from the engine 11 and frame 12. As illustrated herein, muffler 21 has an arcuate heat shield 22 therearound and a tail pipe 23 extending therefrom. The second end 24 of muffler 21, i.e. the end 24 of the muffler opposite from the first end 19 thereof to which the exhaust pipe 16 is connected, is supported by the muffler mount 26 of the present invention.

FIG. 1 also illustrates, in phantom, portions of the radiator 27 associated with the engine and portions of a frame-mounted counterweight system 28. In many vehicles, overall design considerations are such that the radiator 27 and counterweight system 28, and other vehicle components (not shown) must be located relative to engine 11 such that there is a minimal amount of room in which the muffler 21 may be located and such that air flow past the muffler, needed to cool the muffler, is considerably restricted.

Front engine mount 13 comprises a bracket 31 fixed to engine 11 and supported on frame member 32 of frame 12 by a resilient pad 33, the bracket 31 being secured to frame member 32 by bolt 34.

Rear engine mount 14 comprises a rigid yoke 36 having a horizontal cross-member 37 and forwardly extending arms 38 and 39 which are bolted to the engine. The cross-member 37 is supported on frame member 41 of frame 12 by a resilient pad 42 and is held in place relative to the frame member 41 by bolt 43.

The muffler mount 26 comprises a rigid muffler support bracket 46 having a lower flange 47 securely fixed, as by screws 48, to cross-member 37 of yoke 36, an upwardly extending portion 49 and a horizontally extending arm 51. Because of the fixed connections of bracket 46 to yoke 36 and yoke 36 to engine 11, bracket 46 and arm 49 thereof will move in unison with engine 11. That is, if engine 11 moves relative to the frame 12 because of engine vibration or vehicle shock, bracket 46 will also so move.

A relatively thin, flexible, generally vertical, metal hanger 52, comprised of a plurality of thin sheet metal strip elements 53, overlaid on one another in face-to-face relation, extends downwardly from bracket arm 51 to muffler 21 with the hanger 52 being generally perpendicular to the lengthwise axis of muffler 21. As best seen in FIGS. 3 and 4, the first, or upper, end 54 of hanger 52 is firmly fixed to bracket arm 51 by washer plate 56 and bolts 57, while the second, or lower, end 58 of hanger 52 is firmly fixed to end 24 of muffler 21 by spacer block 59, washer plate 61 and bolts 62.

Preferably, three metal strip elements 53 are used to make up hanger 52, each strip element being approximately 0.2 inches in thickness, so that the hanger 52 will have the desired strength and flexibility to provide proper support for muffler 21. Also preferably, strip elements 53 are made of stainless steel stock to provide high resistance to heat, corrosion, and oxidation.

INDUSTRIAL APPLICABILITY

Although its use is not so limited, the present invention is particularly useful in lift truck vehicles.

As is apparent from the foregoing description, any movement of engine 11 relative to frame 12 will be transmitted by the rigid exhaust pipe 16 to end 19 of muffler 21. Such movement of engine 11 will likewise be transmitted through yoke 21, and bracket 46 and hanger 52 to end 24 of muffler 21. This support of the muffler, from both ends thereof, by the rigid exhaust pipe 16 and the rigid bracket 46, which both move in unison with each other, enables the muffler to resist shock and vibration without undue stresses being imposed thereon and without undue stresses being imposed on the muffler mount 26.

Because of the height and relatively large width of hanger 52, the end 24 of muffler 21 will be held securely against vertical, forward, or rearward movement relative to engine 11. At the same time, the thinness of hanger 52 will permit the hanger to flex easily to prevent stresses from being imposed on the muffler on the muffler support because of thermal expansion. For example, axial expansion of muffler 21 will cause hanger 52 to flex laterally. Axial expansion of exhaust pipe 16 will force end 19 of muffler 21 rearwardly away from engine 11, but such force will be relieved by the twisting of hanger 52 about its vertical axis.

The use of a plurality of thin strip elements 53 provides better flexibility than if a single thick element were used, since each strip element 53 can flex independently and follow the contour of the others. Also, since each thin strip element 53 has a small section modulus, the stress level in each strip element is relatively low for a given amount of hanger deflection. As a result, this makes the arrangement highly resistant to fatigue type of loading.

The present invention thus provides a muffler support which is simple and inexpensive, which protects the muffler from stresses resulting from shock, vibration and thermal expansion, and which is highly resistant to heat, corrosion, and oxidation.

Other aspects, objects and advantages of this invention can be obtained from a study of the drawings, the disclosure and the appended claims.

We claim:

1. In an engine and exhaust system (10) having a frame (12), an internal combustion engine (11) resiliently mounted (13,14) on said frame (12), a muffler (21) spaced from said engine (11), a rigid exhaust pipe (16) rigidly connected at one end (17) to said engine (11) and at the other end (19) to said muffler (21), the improvement comprising:

a rigid muffler support bracket (46) connected to said engine (11), a flexible, generally vertical, metal hanger (52) having a first end (54), and a second end (58) and being connected at the first end (54) to said muffler support bracket (46) and at the second end (58) to said muffler (21), said second end (58) being connected to said muffler (21) at a location (24) on said muffler (21) spaced a substantial distance from the connection of said exhaust pipe (16) to said muffler (21).

2. The improvement as set forth in claim 1, wherein said hanger (52) comprises a plurality of relatively thin, individual strip elements (53) overlaid on one another.

3. The improvement as set forth in claim 2, wherein said strip elements (53) are of stainless steel.

4. The improvement as set forth in claim 1, wherein said hanger (52) comprises three individual stainless steel strip elements (53) overlaid on one another, said strip elements each being approximately 0.2 inches in thickness.

5. The improvement as set forth in claim 1 wherein said muffler (21) is generally cylindrical in shape and has first and second spaced apart ends (19,24) and a lengthwise axis, said exhaust pipe (16) is connected to said first end (19) of said muffler (21), said hanger (52) is relatively thin, and said hanger (52) is connected to the second end (24) of said muffler (21) and is substantially perpendicular to said lengthwise axis of said muffler (21).

6. The improvement as set forth in claim 5 wherein said hanger (52) comprises a plurality of individual strip elements (53) overlaid on one another.

7. The improvement as set forth in claim 5 wherein said hanger (52) comprises three individual, stainless steel, strip elements (53) overlaid on one another, said strip elements (53) each being approximately 0.2 inches in thickness.

8. An engine and exhaust system (10) comprising:

a frame (12), an internal combustion engine (11), means (13,14) for resiliently connecting said engine (11) to said frame (12), a substantially cylindrical muffler (21) having first and second spaced apart ends (19,24) and a lengthwise axis and being spaced from said frame (12) and engine (11), a rigid exhaust pipe (16) having first and second ends (17,18) and being rigidly connected at said first end

(17) to said engine (11) and at said second end (18) to said first end (19) of said muffler (21), a rigid muffler support bracket (46) connected to said engine (11); and a relatively thin, flexible, generally vertical, metal hanger (52) having a first end (54) and a second end (58) and being connected at said first end (54) to said muffler support bracket (46) and at the second end (58) to said second end (24) of said muffler (21), said hanger (52) being generally perpendicular to said lengthwise axis of said muffler (21).

9. An engine and exhaust system (10) as set forth in claim 8 wherein said hanger (52) comprises three, stainless steel, strip elements (53) overlaid on one another, said strip elements (53) each being approximately 0.2 inches in thickness.

* * * * *